US009343047B2

(12) United States Patent
Gray et al.

(10) Patent No.: US 9,343,047 B2
(45) Date of Patent: May 17, 2016

(54) HIGH PERFORMANCE GUITAR BRIDGE PINS

(71) Applicants: William Gray, Los Angeles, CA (US); Allen Chance, Los Angeles, CA (US)

(72) Inventors: William Gray, Los Angeles, CA (US); Allen Chance, Los Angeles, CA (US)

( * ) Notice: Subject to any disclaimer, the term of this patent is extended or adjusted under 35 U.S.C. 154(b) by 14 days.

(21) Appl. No.: 13/864,379

(22) Filed: Apr. 17, 2013

(65) Prior Publication Data

US 2014/0311317 A1 Oct. 23, 2014

(51) Int. Cl.
*G10D 3/12* (2006.01)
*G10D 1/08* (2006.01)

(52) U.S. Cl.
CPC ... *G10D 3/12* (2013.01); *G10D 1/08* (2013.01)

(58) Field of Classification Search
CPC ..... G10D 3/12; G10D 1/08
USPC ..... 84/297 R, 298
See application file for complete search history.

(56) References Cited

U.S. PATENT DOCUMENTS 572,677 A * 12/1896 Goodwin ..... 84/297 R
976,428 A * 11/1910 Benson et al. ..... 84/298
4,197,779 A * 4/1980 Holman ..... 84/298
4,202,240 A * 5/1980 Smith ..... 84/297 R
4,366,740 A * 1/1983 Tripp ..... 84/298
4,608,905 A * 9/1986 Takabayashi ..... 84/313
4,608,906 A * 9/1986 Takabayashi ..... 84/313
4,696,218 A * 9/1987 Hoshino et al. ..... 84/297 R
4,807,508 A * 2/1989 Yairi ..... 84/297 R
5,092,213 A * 3/1992 Cipriani ..... G10D 3/04 84/299
5,372,057 A 12/1994 Hart
5,477,764 A * 12/1995 Carrico ..... 84/297 R
5,696,335 A * 12/1997 Rose ..... 84/298
6,111,176 A * 8/2000 Rose ..... 84/297 S
6,143,967 A 11/2000 Smith et al.
6,818,814 B2 * 11/2004 Park ..... 84/298
7,351,895 B1 * 4/2008 LeBlanc ..... 84/298
7,365,255 B1 4/2008 Piskulic et al.
7,394,005 B1 * 7/2008 Anderson et al. ..... 84/297 R
7,534,945 B2 5/2009 Babicz
7,566,823 B1 * 7/2009 Niskanen ..... 84/313
7,807,906 B2 10/2010 Dain
7,842,869 B2 11/2010 Adams
7,884,271 B2 2/2011 Dain
7,906,715 B2 3/2011 Coco et al.
8,110,729 B2 2/2012 Guthrie et al.
D662,128 S * 6/2012 Nuttall ..... D17/20
8,378,191 B2 2/2013 Barillaro
8,381,377 B1 2/2013 Poliak et al.
9,190,032 B2 * 11/2015 Heuss ..... G10D 3/12

* cited by examiner

*Primary Examiner* — Robert W Horn

(57) ABSTRACT

Guitar bridge pins are formed of hard materials shaped to mechanically cooperate with standard guitar bridge configurations. Either molded or machined into a prescribed shape, guitar bridge pins fit into tapered shaped holes of most common guitar bridges. Guitar bridge pins of these systems include a main body portion into which a recess seat is formed. Further a string via is arranged from the recess seat to an exit aperture, the string via provides a path through which a guitar string may pass. These guitar pins provide a high-performance system for mounting and fixing guitar strings at the bridge of a standard guitar. Specifically these bridge pin devices include at least four major integrated elements including a main body, a recess seat, a string via and a stud element. Additionally, these bridge pin systems may also include cooperating spacing and locking washers which may be used in conjunction with threaded fasteners. When fastened to a guitar bridge as prescribed, these bridge pins securely couple guitar strings there to while additionally holding together a bridge assembly including the bridge plate, sound board and bridge.

8 Claims, 8 Drawing Sheets

Top View

Section A-A

HIGH PERFORMANCE GUITAR BRIDGE PINS

PRIORITY CLAIM

This application claims benefit from an earlier filed provisional application having Ser. No. 61/658,926 filed on 13 Jun. 2012. That application is hereby incorporated by reference.

BACKGROUND OF THE INVENTION

Field

The following invention disclosure is generally concerned with string musical instruments and in particular guitar, and specifically concerned with coupling of said strings to the guitar sound board via the bridge.

Guitar and some other similar string instruments typically include facility for fastening a string under tension to a soundboard whereby energy is acoustically coupled from vibrating strings into air surrounding the instrument. As such, a plucked string is excited into a vibrational mode and further excites vibrations at the soundboard and resonances of the instrument's cavity. Accordingly, specific arrangements which are the interfaces between strings and a soundboard have important impact on the acoustic signature of the instrument.

A first end of a guitar string is affixed at the guitar's bridge. The bridge is arranged to convey energy carried by vibrating strings to a soundboard and further to a resonator cavity. This is primarily done via at the bridge saddle which is a first point of contact for the vibrating string and as such forces a vibrational node there. The second end of the guitar string is affixed at the head stock and more specifically by way of tuning keys.

By very long-standing tradition, acoustic guitars generally include strings which are affixed to a soundboard at a system called a bridge. A typical guitar bridge includes a primary member into which six (usually six) tapered holes are cut, the saddle, bridge pins, and a bridge plate on the interior of the soundbox. Together, these elements make up the guitar bridge.

A guitar string is mounted to the bridge by way of the tapered holes in the bridge. Specifically, a string's 'ball-end' is inserted through a conic shaped hole in the bridge and a bridge pin of a complementary conic shape is pushed into the hole such that the string and the bridge pin together fin the hole. Since the ball-end is trapped at the bridge plate in the interior of the resonator, the string is held securely to the bridge. Tension applied to the string further secures it to the bridge. Guitar strings by tradition have long been affixed in this fashion despite some shortcomings found in these rather in elegant mechanical couplings.

The mechanical couplings between a guitars strings and its soundboard can significantly impact tonal qualities of the sound produced. Generally speaking, a more pure spectrum (of vibrational frequencies) is conveyed to the soundboard where the coupling does not excite extraneous vibrational modes, but rather conveys energies of the strings faithfully to the soundboard.

To fasten a guitar string to a typical acoustic guitar at the guitarist's bridge, one merely inserts a 'ball-end' of the string through a tapered hole in the bridge whereby the string and enters the resonator interior cavity. While pushing the string toward the side of the hole, the string is slightly pulled to cause the ball-end to catch at an edge of the bridge plate. A conventional bridge pin is inserted into the hole trapping the string against the bridge plate, sometimes a slot is cut into a bridge pin whereby the string will fit tightly therein. Further tension applied to the string is met by an opposing resistance as the ball end is trapped at and cannot pass the bridge plate so long as the bridge pin remains in place.

A first major problem with fastening strings in these conventional arrangements relates to damage at the bridge plate. Due to the tension and vibration which is transmitted on the string the string will degrade and wear at the bridge plate which is usually made of wood. This wear tends to enlarge and open holes at the bridge plate making it more difficult to properly seat strings at the same site on future uses. Since bridge plate is made of wood, it is susceptible to wear and thus has a finite lifetime. Damage from strings affixed at a bridge plate is nontrivial and ultimately affects the usability and performance of the guitar very further, it is not easy to repair guitars that have heavily worn bridge plate.

Another important problem relates to audio purity. While most of the vibrational energy of the string is conveyed to the resonator or soundbox via the bridge saddle, a portion is nevertheless transmitted via the bridge pins and bridge plate. This is sometimes undesirable because complex and asymmetric shapes of the bridge pins as well as the non-uniform seating of the string ball-ends can result in stimulation of unwanted vibrations. To achieve a more pure sound, these means of unwanted energy transmission are preferably isolated from the sound box.

Inventors Poliak et al present in their invention recorded as U.S. Pat. No. 8,381,377 a novel bridge system for string instruments and particularly a guitar. Issued Feb. 26, 2013, this new bridge arrangement promotes a preferred manner in which guitar strings may be secured and coupled to the soundboard. Specifically, an 'entrapper' system captures and holds the ball end of a guitar string whereby that ball end no longer operates to degrade a wooden bridge plate of traditional guitars.

In U.S. Pat. No. 8,378,191 issued Feb. 19, 2013, Barillaro of Austria presents a new invention of a soundboard bracing structure. Similarly, this invention helps prevent damage at a soundboard by redirecting load tension from the strings via triangular blocks. A 'spoke like' pattern of load distribution members tend to distribute forces in a manner which alters performance of the system.

Guthrie et al, of Austin, Tex., no known relation to Arlo Davy Guthrie, nevertheless designed and discovered uses of pyrolytic carbon materials which are alleged to produce richer clearer sound when employed as bridge saddles, nuts, frets, tuning heads, pegs, et cetera. Because a major Objective in the present teaching related to bridge pin elements of complex shape which may be molded or machined, this new material may be directly applied in some versions of the present invention to give further advantages thereto.

A guitar bridge pin puller is taught in U.S. Pat. No. 7,906,715 by inventor Coco et al.

A new string bridge interface—which is essentially another form of bridge pin system is presented by Inventor Dain in U.S. Pat. No. 7,884,271 of Feb. 8, 2011. This device and system is most important as it is related to some of the concepts disclosed in the present description. Particularly, use of a threaded fastener in conjunction with a hole in a conventional guitar bridge.

Adams of Hamburg presents a recess seat portion of a string anchor device for an acoustic string instrument. A similar construction which permits a guitar string ball-end to couple with anchors of the present teaching are used. However, the seat of Adams is distinct and does not provide any advantage over the configurations first shown in the following descriptions.

Dain (mentioned above) additionally has patented a "String-Bridge Interface System and Method" described in U.S. Pat. No. 7,807,906. This system shows how strings may be coupled and connected to a soundboard to reduce loading thereof.

New York inventor Babicz presents a "String Instrument" in U.S. Pat. No. 7,534,945 where "the lower end of the strings are anchored to the soundboard itself with one or more of the string anchors being positioned past the bridge". This system includes a string retainer body secured separately from the bridge body. Similarly in the present invention, the string ends are removed from the soundboard and are separated from the bridge body.

An optimally coupled string instrument bridge is taught and presented in U.S. Pat. No. 7,365,255. An individual bridge assembly supported each string. In the teaching which follows this background, systems are presented where each string individually is seated in a separate device. However, inventors Pinkulie et al teach away from the concepts described here as they only describe systems in which the strings are terminated at the interior of the resonator cavity.

Finally, Smith of U.S. Pat. No. 4,202,240 teaches of an alternative bridge pin system. This system terminates a guitar string at the exterior of the sound box cavity—however the interface between the bridge pin and bridge has several shortcomings. Firstly, although the height is adjustable via a complex mechanical interlock system, that system assures poor acoustic coupling from the string to the soundboard. Further, some installations of these systems require drilling oversized holes in the bridge which forever damage the guitar in a manner which cannot be undone later.

While systems and inventions of the art are designed to achieve particular goals and objectives, sonic of those being no less than remarkable, these inventions of the art have nevertheless included limitations which prevent uses in new ways now possible. Inventions of the art are not used and cannot be used to realize advantages and objectives of the teachings presented herefollowing.

SUMMARY OF THE INVENTION

Comes now, Allen Chance and William Gray with inventions of guitar bridge pins that include devices for coupling guitar strings to the bridge portion of a guitar. It is a primary function of these devices to provide novel means of fastening guitar strings to a guitar at the bridge thereof.

Guitar bridge pins in accordance with these teachings are arranged to accommodate and mount guitar strings at a guitar bridge without modification with respect to industry standard guitar bridges. These arrangements more securely affix guitar strings with improved acoustic coupling. Furthermore, these bridge pin systems prevent wear damage which is commonly found in state-of-the-art systems where a soft wood bridge plate is used. Bridge pin systems first disclosed herein are easy to use, durable, and more artistically attractive. Moreover, these bridge pin arrangements improve the audio output of a guitar as a result of superior coupling of a guitar string to the soundboard.

These guitar bridge pins are primarily characterized as comprising a main body member having therein a string via formed as either a hole in a solid body section or a slot similarly formed therein one side of the main body. Bridge pins further comprise a coupling stud formed as a conic section which operate as a mechanical mate with respect to common guitar bridge arrangements which include tapered receiving holes for bridge pins.

Common bridge pins on a standard guitar may be removed to permit a guitarist to replace worn strings with new ones. instead of using the standard guitar pins, a guitarist may chose instead to use guitar pins in conformance with the descriptions herefollowing. It is not necessary to physically modify a guitar bridge in order to install these novel bridge pins. Rather, these bridge pins are designed and arranged to cooperate directly with standard guitar bridges.

To restring a guitar, the artist merely removes and discards the old bridge pins and strings. Thereafter a new guitar string is inserted into the appropriate space of a bridge pin and in particular such that the sting ball-end. is fitted at and seats in a recess provided for receiving the ball-end or other string hardware. The bridge pin is affixed at the bridge by inserting a coupling stud through the tapered hole of a bridge—the same hole from which a standard bridge pin was removed. However, as the guitar string's ball-end no longer enters the interior of the guitar body nor engages the bridge plate, the bridge pin adapts an alternative manner of securely attaching to the guitar. In best versions, a threaded fastener is used in conjunction with any necessary washers to further pull the bridge pin into the tapered hole thus securing it snugly therein. By trapping the bridge plate, sound board and bridge together with compression forces from the bridge pin and its threaded fastener, the system tends to hold together these parts in a most secure fashion while preventing damage at the wooden bridge plate. As typical guitars include six strings, the process is repeated for each string. A separate bridge pin is mounted by a screw through the tapered bridge holes providing means to affix the guitar strings securely thereto the bridge.

OBJECTIVES OF THE INVENTION

It is a primary object of the invention to provide guitar bridge pins.

It is an object of the invention to provide bridge pins which non-intrusively affix to a standard guitar bridge.

It is a further object to provide guitar bridge pins which provide superior coupling for standard acoustic guitars.

It is an object of the invention to provide acoustic guitar bridge pins having superior appearance and function.

It is additionally an object of the invention to provide guitar bridge pins which are easy to use and install.

It is also an object of the invention to provide guitar bridge pins which avoid damage to a guitar bridge plates during installation and use.

A better understanding can be had with reference to detailed description of preferred embodiments and with reference to appended drawings. Embodiments presented are particular ways to realize the invention and are not inclusive of all ways possible. Therefore, there may exist embodiments that do not deviate from the spirit and scope of this disclosure as set forth by appended claims, but do not appear here as specific examples. It will be appreciated that a great plurality of alternative versions are possible.

BRIEF DESCRIPTION OF THE DRAWING FIGURES

These and other features, aspects, and advantages of the present inventions will become better understood with regard to the following description, appended claims and drawings where:

PREFERRED EMBODIMENTS OF THE INVENTION

In contrast to arrangements of bridge pins well-known in the arts, bridge pins of these systems are particularly characterized as being formed of a main body portion having a string via therein, further having a seat recess to receive a guitar string ball-end, and a conic shaped coupling stud member. On some typical guitars, six independent but identical bridge pins are used together, one bridge pin for each of six strings. While it is certainly possible to integrate six bridge pins together as a single device to accommodate six strings ensemble thus achieving all of the advantages of these systems, preferred versions of these bridge pin sets include six identical elements which stand alone as individuals rather than being integrated together as a single element.

Figure 1:
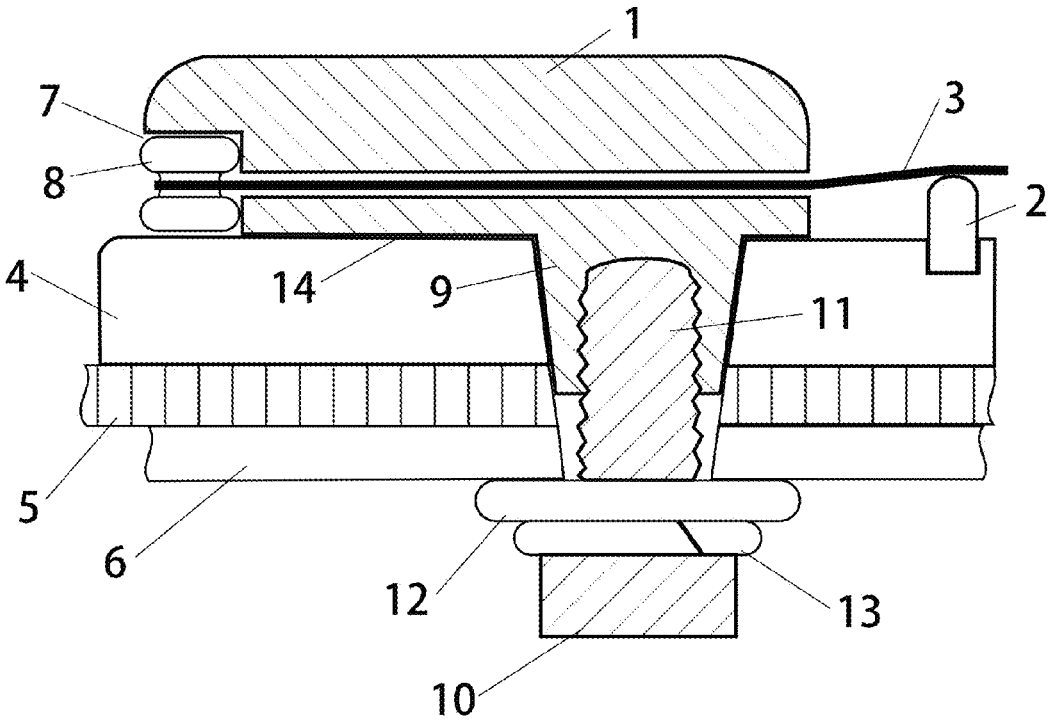
FIG. 1 is cross section illustration of a bridge pin coupled with a guitar bridge and guitar string.

A full and rigorous understanding of the invention and various embodiments thereof is had in consideration of the drawing of FIG. 1 which includes an illustration of a single bridge pin in accordance with this teaching and further in conjunction with the following description including reference numerals therein. In particular, most preferred versions of a bridge pin is shown in the cross-sectional drawing which is FIG. 1. The bridge saddle 2 portion directly transmits vibrations of a guitar string 3 into the bridge 4 and further the soundboard 5 which lies beneath the bridge and is affixed thereto generally by adhesives. A bridge plate 6 is sometimes used as a backing which provides additional strength to the bridge.

While most common arrangements of guitars include a string ball-end. trapped at a bridge plate via a common conic shaped bridge pin, the bridge pins first presented here include an important variation whereby the ball-end of the string does not pass through the hole in the bridge but rather is affixed to a seat (or herein 'recess seat') external with respect to the resonator cavity.

A bridge pin of the systems includes recess seal 7 into which a string ball-end 8 is fitted and coupled. The seat is fashioned and arranged such that any tension applied along the length of the string tends to encourage the ball-end to more securely remain in the seat. A bridge pin of these systems further includes the important construct which couples with a hole in a common guitar bridge. A conic shaped coupling stud 9 may be formed to very securely fit into the holes of conventional acoustic guitar bridges. Such holes are traditionally tapered (conic) and sometimes at either three or five degree half-angle or some other small half-angle of a few degrees.

One important distinction from the art where most traditional bridge pins include a slot running axially along the conic surface to accommodate the string therein, the bridge pins of this teaching do not include such slot nor any analogous feature. The conic shaped coupling stud is quite symmetric axially. As such, it forms an interface with the bridge hole into which it is fitted that affects evenly distributed (radially) forces without bias in any particular direction. Because these bridge pins which do not include slots to accommodate a string uniformly seats with the bridge hole, the forces imparted to the bridge via the bridge pin are also be even or symmetrical. Accordingly, bridge pins which more uniformly mate and couple with the guitar bridge holes results in better mechanical fidelity.

A most preferred manner in which these bridge pins are mechanically affixed to the bridge includes use of a cooperating threaded fastener system. A simple machine screw 10 (e.g. Allen bolt) having a cylindrical member with threads thereon may form a mechanical interlock by way of complementary threads formed in the coupling stud portion of the bridge pin. Such mechanical interlock fastener has some important advantages in these particular arrangements. Where a bridge pin includes a conic shaped coupling stud as described and shown in the figures, a threaded fastener tends to further seat and coupled the bridge pin by way of its cooperating mechanical shape into the complementary shape receiving hole at the bridge. Because threaded fasteners intrinsically include means of applying a highly regulated force, such arrangements of bridge pins tend to further enhance the uniform and symmetric couplings between bridge pins and the bridge. This advantage cannot be found in similar versions of the arts. As a result, these systems can be expected to have superior sound and audio purity.

Another very important advantage of using a threaded fastener to secure a coupling stud into a receiving hole of a conventional guitar bridge relates to improvements in manufacturing processes. When a machine screw is used with a simple spacing washer 12. and sometimes additionally with a lock type washer 13, a significant and important upward compression force on the bridge plate is realized. As a bottom surface of the bridge pin may be fashioned as a planar region 14 it operates in conjunction with the washers to squeeze together the bridge plate, and the soundboard and the bridge. In conventional guitars of the art, these three elements are affixed together with adhesives. However adhesives age in time and with this aging adhesives sometimes degrade. Further, use of adhesives to hold together the bridge plate, soundboard and bridge is accompanied by the disadvantage that assembly includes long drying periods of up to several days. In a system where adhesives are omitted and not used, a considerable manufacturing advantage may be realized by not having an adhesive drying step.

As it is convenient to provide with these bridge pins cooperating sets of machine screws, it becomes necessary to account for variances between standard guitars. In particular, since various soundboard thicknesses and bridge thicknesses are certainly found between all models of guitars, need will arise to adjust spacing with respect to the distance between the machine screw head seat and the planar surface of the bridge pin which engages the bridge.

Spacing washers may be provided where a machine screw is too long (i.e. where bridge, bridge plate and soundboard are all very thin) in such circumstance, a machine screw operates better when used with one or two spacing washers 12.

In addition, some versions of these systems when deployed in best arrangements includes 'lock' type washer 13. A lock washer may include a gap or slot funned therein. Further the locking washer may include some spring steel, elasticity or 'memory' which causes it to tend to return to a prescribed state whence put under pressure. In this way, vibrations which are likely to be present in the bridge pin couplings will not operate to uncouple the bridge pin from the machine screw. The lock washer helps to prevent such undesired decoupling. As such use of both lock washers and spacer washers are anticipated in various important versions of these systems.

Figure 2:
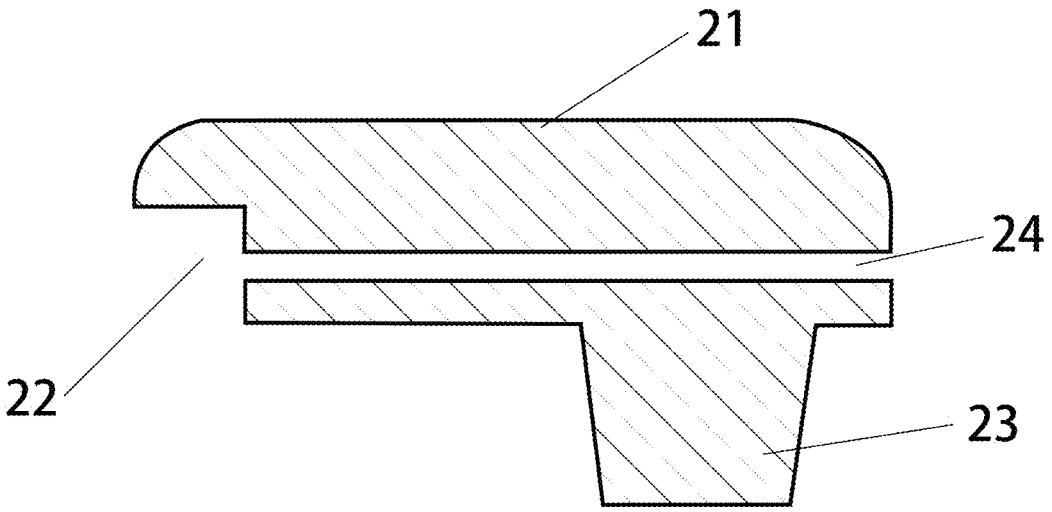
FIG. 2 is a simple guitar bridge pin illustrated in isolation.

To provide a most complete understanding, FIG. 2 shows a bridge pin of the invention in isolation. A bridge pin of these systems is comprised of four major elements including: a main body portion 21, a recess seat 22, a coupling stud 23, and a string via or pathway 24. A bridge pin is preferably formed as a single piece of durable hard material. Hard plastic, bone, ivory among other materials are suitable for making these bridge pins. However, in most preferred versions, bridge pins are made of metal or metal alloys. Metal may be molded or cast into complex shapes such as those necessary to support the form and function described herein. It is similarly possible to machine bridge pins of these inventions, however some versions of machined bridge pins may be prohibitively expensive to manufacture as machining can be time intensive.

Metal bridge pins additionally support some useful artistic features compatible with parts and used on musical instruments. For example, a metal bridge pin may be formed of metal and plated with gold or chrome and polished to get a superior smooth good-looking finish. Metal may be anodized or 'brushed' to impart a colored and/or textured appearance which is quite attractive. For these reasons among others, metal is preferred material from which these bridge pins may be formed.

The recess seat 22 is characterized as a space or open cavity formed into the main body portion of the bridge pin. The recess having particular shape and size is intended to cooperate with a standard guitar string terminal hardware often referred to as a 'ball-end'. While the standard ball-end is quite ubiquitous and thus the recess size and shape is implicitly well-defined, it remains within the scope of this teaching to include variances for custom terminal hardware which may be used at the end of a guitar string. A recess seat operates to receive and hold the terminal hardware of a guitar string whereby the string cannot separate from the bridge pin when tension is applied thereto, i.e. when the string is pulled.

As an illustrative example of a possible variation of a recess seat, the reader will imagine a guitar string without terminal hardware. A simple knot may be tied at the end of the string and a recess seat for this example may simply be the aperture end of a hole drilled through the metal body of the bridge pin. Since the hole has a diameter sufficiently smaller than the diameter of the knot tied in the string, the string would be prevented from passing through the body of the bridge. Accordingly, this version of a recess seat would be quite minimal. Of course this most inelegant version is unlikely to be deployed as a preferred embodiment. However, it is introduced here to illustrate one does not traverse the balance of the invention definition merely by deviating from those more tidy versions presented in other examples here throughout. Rather, the essence and spirit of the invention is clearly met in any implementation in which the end of a guitar string is held by mechanical means adjoined by a string via aperture.

A coupling stud element 23 of these guitar pins is a most important part of the system.

The stud is preferably fashioned as a conic shaped member where the conic shape is complementary to the conic shaped holes of common acoustic guitars. Studs are best formed as an axially symmetric element without any slot typically found on a bridge pin in the art. Rather, these bridge pins include a highly uniform stud of conic shaped which forms a tight coupling with holes in the bridge of common guitars.

In some preferred versions, the stud element may have a conic section shape which is characterized by a half-angle of particular nature. Because the holes in the bridge is of most guitars are conic shaped with a half-angle of either 3° or 5°, very good coupling with either of those two configurations may be achieved with the same bridge pins. Where the stud is provided with a half-angle of 4°, the stud will mate with and couple with both 3° systems, and 5° systems. Accordingly, some versions of the studs are specifically arranged with a coupling stud having a conic section whereby the conic is defined as having a half-angle of 4°. Of course, where it is desirable for a set of bridge pins to cooperate specifically with either a 3° bridge or a 5° bridge, studs may be fashioned with the preferred complement—either 3° or 5°.

It is of very significant importance that the stud elements of these bridge pins are provided with particular mechanical means to further couple them to the guitar bridge. In best versions, the conic stud is additionally provided about its axis a threadset which operates in conjunction with cooperating threaded fasteners such as screws or bolts. Because it is desirable to securely fasten the bridge pin to the guitar, a threaded fastener provides an exceptionally good means of holding the bridge pin in place in the bridge tapered hole. Common guitars in contrast rely upon a pressure fit or a friction fit with respect to the tapered hole and the bridge pins inserted therein. This type of coupling is not feasible in the bridge pin configurations taught herein in part because the guitar string no longer engages with the bridge plate to apply lateral pressure on the bridge pin which tends to hold it in place. In the configurations of bridge pins presented herein, there are no strings in the tapered holes of the bridge and thus no lateral pressures put upon the bridge pins. As such, these bridge pins are best held in place by a threaded fastener rather than a pressure fit most common in the art. For this reason, certain versions of those bridge pins include a conic shaped stud with a threaded hole (female) disposed about the conic axis.

These bridge pins further include a string via or pathway 24. So that a string held by the recess seat may pass through the main body of the bridge pin, a hole or slot is provided in the bridge pin body. This hole has a first aperture at the recess seat and a second aperture on an opposing end or side of the bridge pin. A guitar string properly mounted to a guitar deploying these bridge pins passes through the string via and terminates at the recess seat where it is held under tension.

Figure 3:
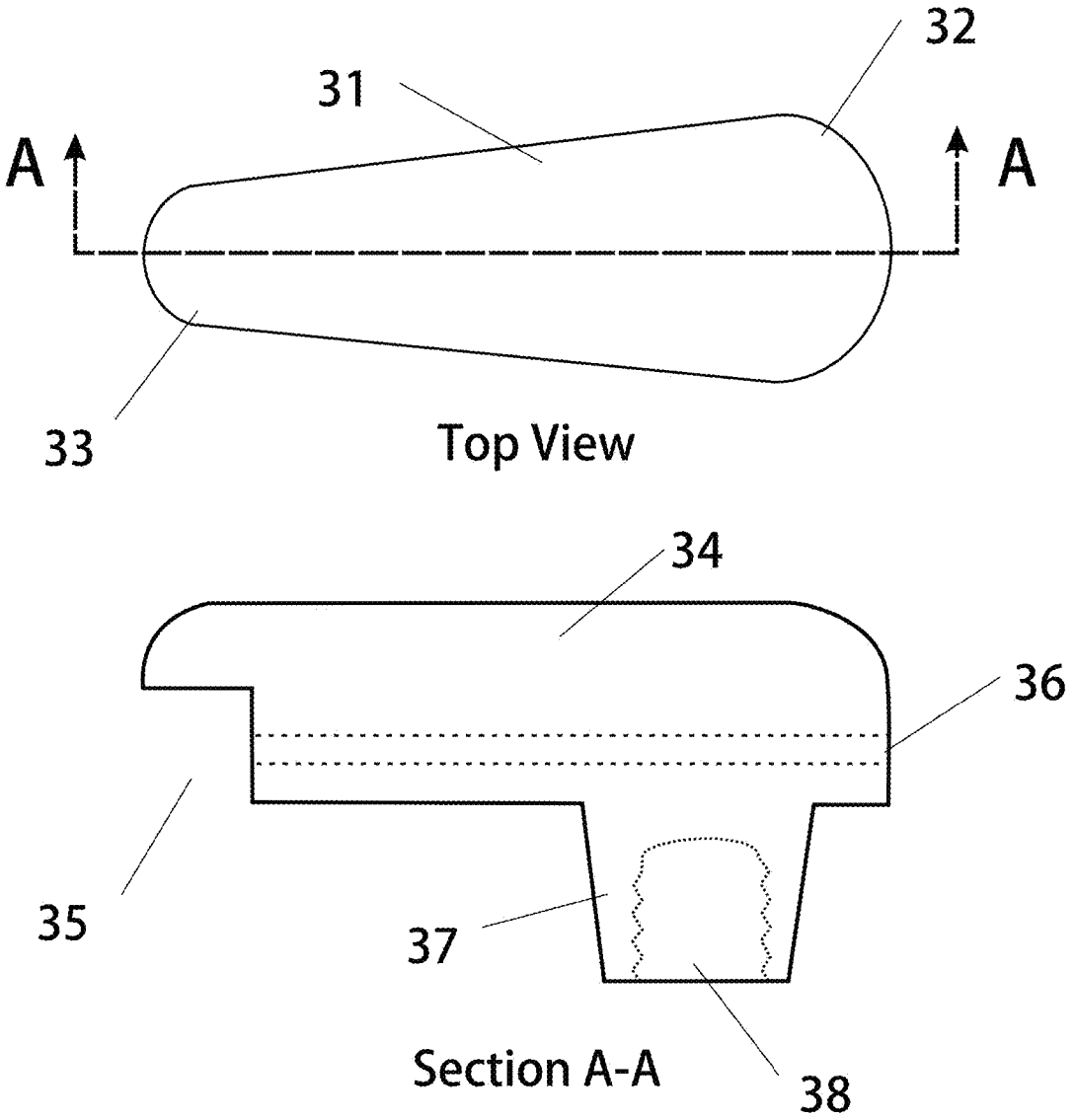
FIG. 3 shows a top view and sectional view of a bridge pin.
Figure 4:
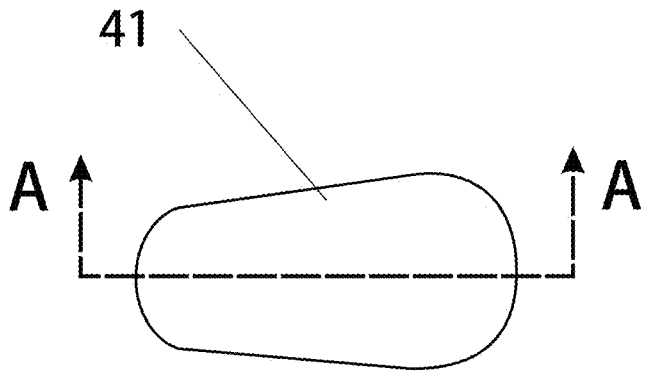
FIG. 4 illustrates an alternative design of a similar bridge pin.
Figure 4:
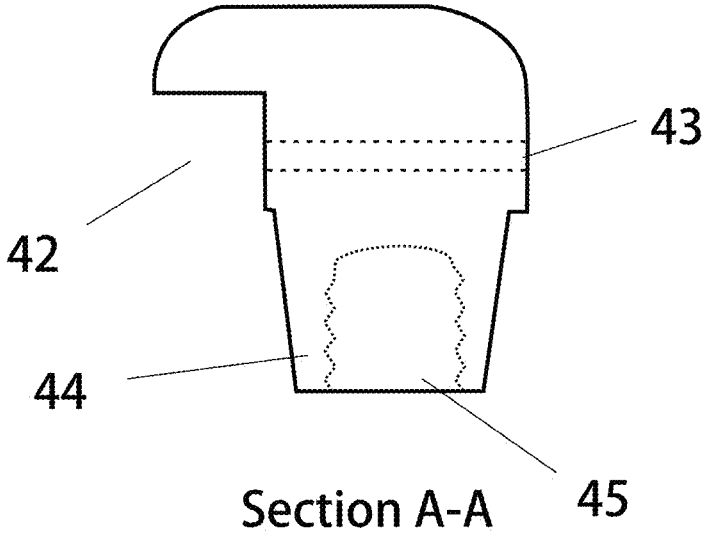

More detail of the design and nature of these guitar bridge pins is illustrated by the drawing of FIG. 3 where a single bridge pin is shown in a top view and sectional view simultaneously. In the top view, a bridge pin design includes a main body 31 formed as an asymmetric elongated orb having a first end 32 which is slightly larger than an opposing end 33 which has a smaller width. In some versions, it is preferable to make the smaller end of a size similar to but slightly larger than a standard guitar string ball-end. In the sectional view the main body 34 includes a recess seat 35 which accommodates therein the ball-end of a guitar string and further a string via 36 through which a guitar string may pass. Still further the bridge pin includes the conic shaped coupling stud 37 which has cut the therein threadset 38. Various versions may provide for some latitude with respect to design. For example, the elongation may be reduced without having any appreciable effect on performance nor function. FIG. 4 illustrates a shorter 'stubby' bridge pin which operates identically to those shown in FIG. 3 but with a slight design variation. Accordingly, the reader will appreciate that one can achieve many alternative attractive designs while still incorporating the full function and performance of the present teaching. As such, these design changes should not be considered a new invention but rather mere variation of the invention described in this document the full metes and bounds of which are set forth in the appended claims. A shorter design of a guitar bridge pin in conformance with this teaching includes a main body element 41, a recess seat suitably shaped whereby a guitar string ball-end may be received and held therein, a string via through which a guitar string may pass, and a conic shaped coupling stud element 44 having therein a mechanical interlock system 45 (threads) form axially therein.

Figure 5:
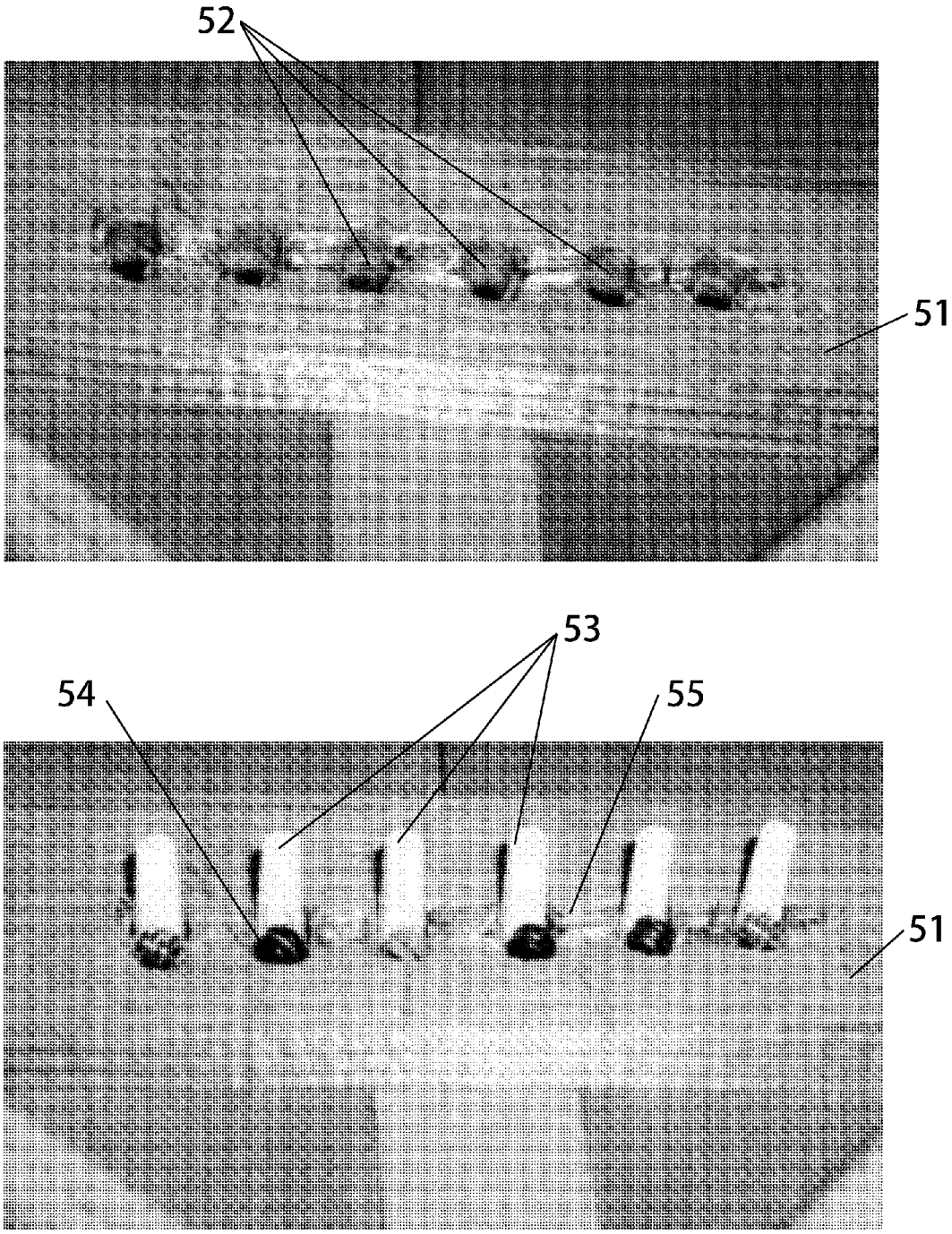
FIG. 5 (Prior Art)
FIGS. 5 and 6 are prior art drawings showing bridge pins of the art for comparison.

To gain a more complete understanding one is reminded to consider prior art systems and related problems found there which gives rise to motivation for improvements explained herein. FIG. 5 illustrates a typical bridge plate found on an internal surface of a common guitar body. A bridge plate 51 includes six tapered holes 52 (typically either 3° or 5°). When the guitar is properly strung, one can view the end of typical bridge pins 53 which have been inserted into the holes and are held there by pressure in part from the string ball-end 54. Over time damage is done to the bridge plate as wear causes divots and holes and other damage 55 to the bridge plate. After many years of re-stringing a guitar, extensive damage at the wooden bridge plate can occur. The damage can become so severe that the bridge plate requires replacement which might even render the guitar irreparable.

Figure 6:
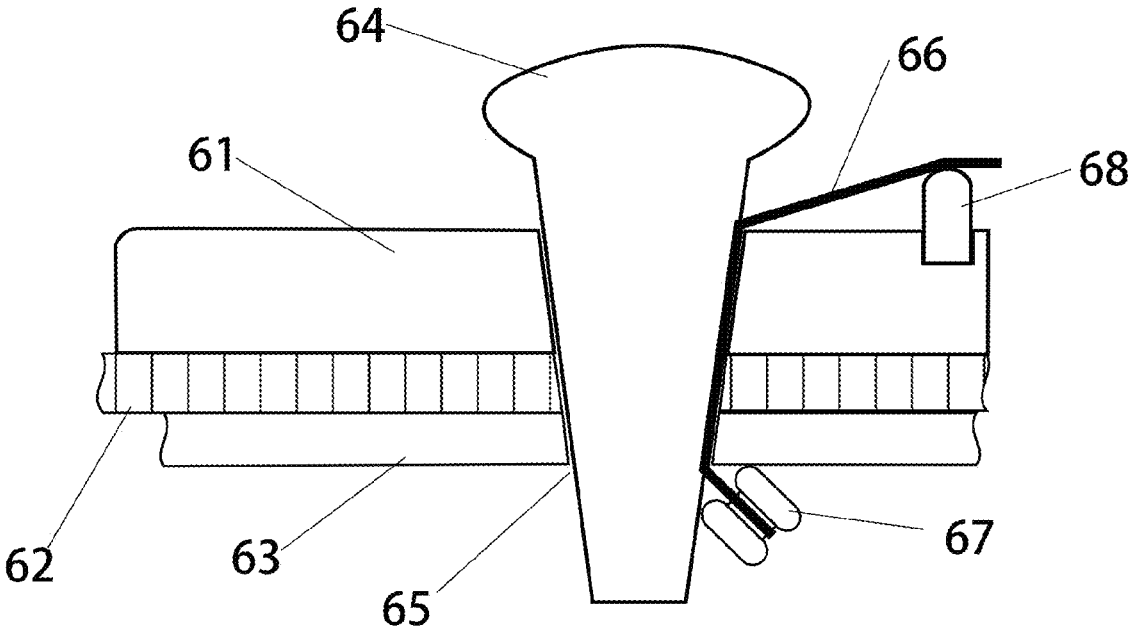
FIG. 6 (Prior Art)

A line drawing which illustrates for comparison most commonly used systems for mounting guitar strings is presented as FIG. 6. A guitar bridge 61 sandwiches a soundboard 62 between it and a bridge plate 63. A bridge pin 64 is pushed through a tapered hole 65 to hold a guitar string 66 trapped at the bridge plate via its ball-end 67. The guitar string rests on the bridge saddle 68.

Figure 7:
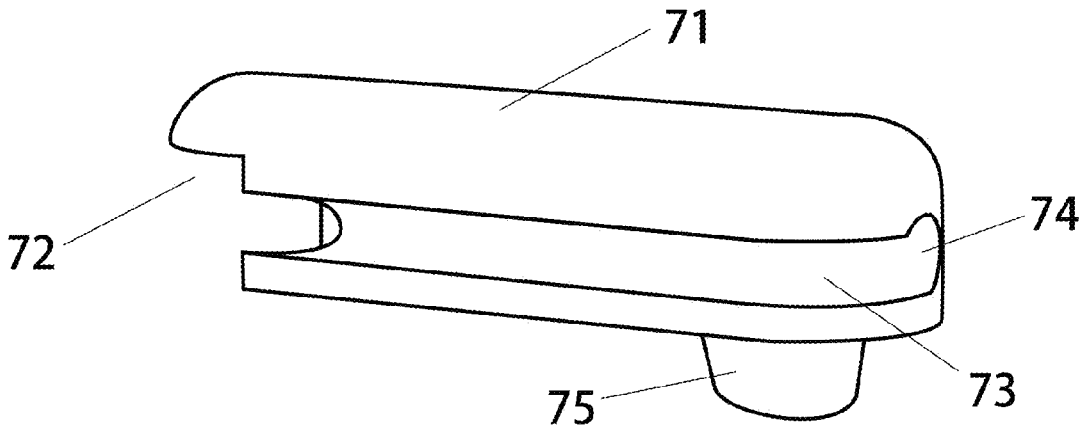
FIG. 7 shows an important alternative version of a bridge pin.

FIG. 7 illustrates an important variation mentioned earlier. In some versions a string via is embodied as a slot rather than an enclosed hole. A slot permits preferred access and ease of use—particularly when restringing a guitar. Another important advantage relates to damage at the exit aperture of the string via. When pulling a guitar string through an enclosed hole, the string may rub and grind at the edge of the aperture.

A preferred system which avoids such damage includes a bridge pin main body which includes a slotted via which a string may be easily passed without having to putt the entire length of the string through the via. In this way, one avoids the possibility of damaging the end of the device. One example of a slotted bridge pin is illustrated as FIG. 7. A main body 71 includes a recess seat 72, and a slot type string via 73 with exit aperture 74. The coupling stud element 75 is identical to the other versions presented earlier. Thus bridge pins of these systems may be arranged in either of two versions with respect to the string via. In one version, a bridge pin is arranged with a slot alongside of the main body portion. A string may be simply passed through the slot such that the ball-end is received in the recess seat. Any tension put on the string after that tends to hold the string in place by virtue of the fact that the ball-end is affixed to the seat so long as tension is applied in a generally axial direction. In an alternative version, a bridge pin body is fashioned with a through hole rather than a slot. To couple a string to bridge pins of this version, one must pass the string's end (at the end opposite of the ball-end) through the hole and pulled the entire string therethrough to cause the ball-end to couple at the recess seat. Similarly, tension in the axial direction tends to securely hold the ball-end in the recess seat. It is not of important consequence which version is chosen as all advantages of the invention are fully realized in both versions.

Figure 8:
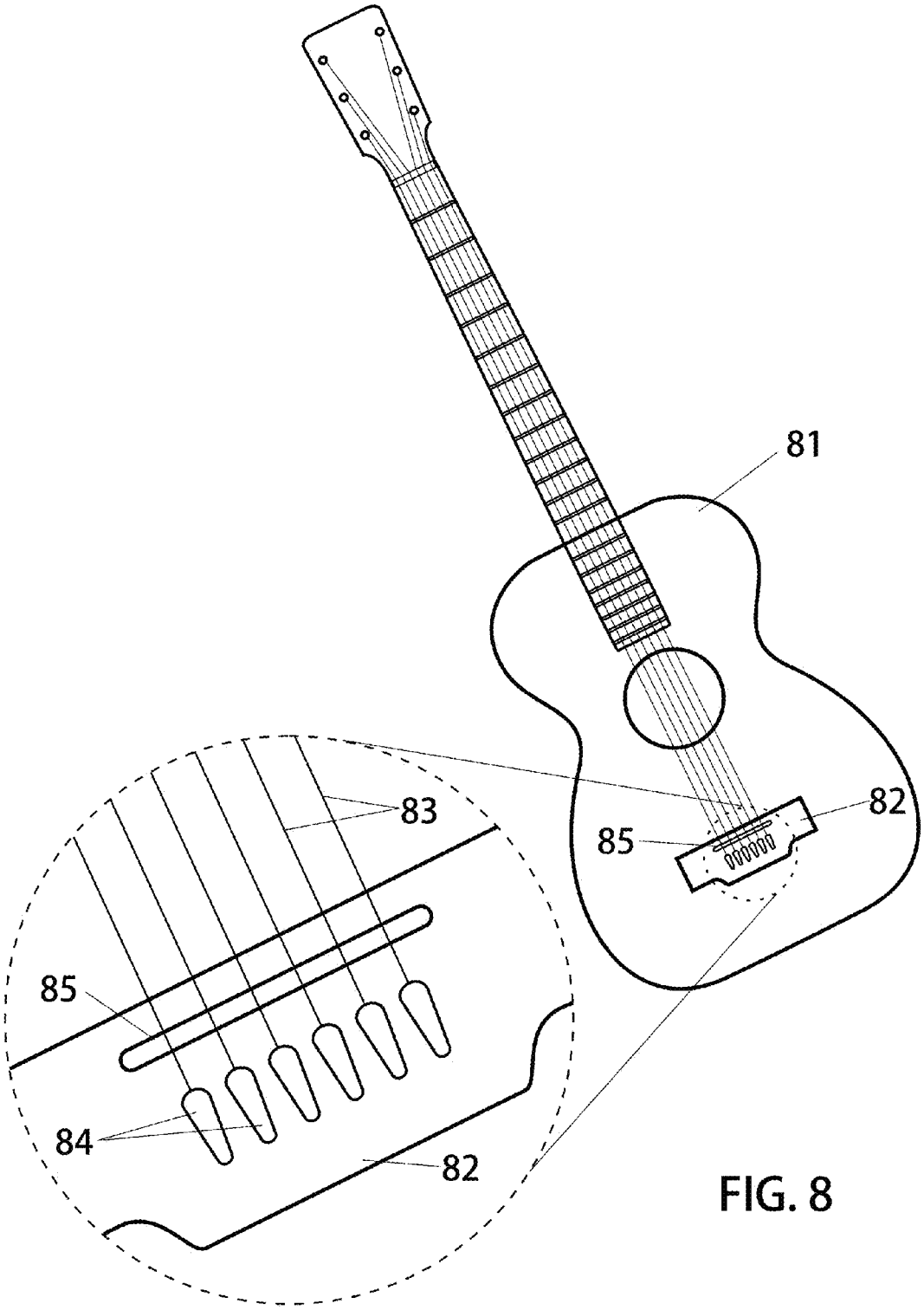
FIG. 8 shows a complete guitar with 6 of these bridge pins installed.

Finally FIG. 8 illustrates a guitar 81 upon which a set of six of these bridge pins are deployed upon that bridge of the guitar. The bridge 82 is illustrated in an expanded view. Six strings 83 are mounted via these bridge pins 84 whereby the strings are held against the saddle 85.

The examples above are directed to specific embodiments which illustrate preferred versions of devices and methods of these inventions. In the interests of completeness, a more general description of devices and the elements of which they are comprised as well as methods and the steps of which they are comprised is presented herefollowing.

One will now fully appreciate how superior high performance guitar bridge pins may be realized, fashioned and used to achieve improved sound and reduce damage to a guitar bridge. Although the present invention has been described in considerable detail with clear and concise language and with reference to certain preferred versions thereof including best modes anticipated by the inventors, other versions are possible. Therefore, the spirit and scope of the invention should not be limited by the description of the preferred versions contained therein, but rather by the claims appended hereto.

What is claimed is:

1. Guitar bridge pins comprising:

a main body element having a via formed therein through which a guitar string may pass, and a coupling stud, said coupling stud is formed as a conic section having a mechanical coupling which cooperates with a guitar bridge, said coupling stud is integrated with said main body as a single piece element, said mechanical coupling is characterized as including a threaded fastener.

2. Guitar bridge pins of claim 1, further comprising a complementary threaded fastener.

3. Guitar bridge pins of claim 2, further comprising lock and spacer type washers.

4. Guitar bridge pins of claim 1, said via is fashioned as a hole.

5. Guitar bridge pins of claim 1, wherein via is fashioned as a slot.

6. Guitar bridge pins of claim 1, further comprising a recess seat formed into said main body.

7. Guitar bridge pins of claim 6, said recess seat is formed in a shape complementary with respect to a guitar string ball end.

8. Guitar bridge pins of claim 2, said mechanical coupling is arranged whereby a compression force is exerted upon a guitar bridge, bridge plate and sound board such that these are compressed and held firmly together.

* * * * *